US006190270B1

(12) United States Patent
Barry

(10) Patent No.: US 6,190,270 B1
(45) **Date of Patent: *Feb. 20, 2001**

(54) ATHLETE PRACTICE SHOOTING AID DEVICE

(75) Inventor: Richard E. Barry, Stanhope, NJ (US)

(73) Assignee: Sports Scoring Aides Ltd., W. Orange, NJ (US)

( * ) Notice: Under 35 U.S.C. 154(b), the term of this patent shall be extended for 0 days.

This patent is subject to a terminal disclaimer.

(21) Appl. No.: 09/141,470

(22) Filed: Aug. 28, 1998

Related U.S. Application Data

(63) Continuation-in-part of application No. 08/796,768, filed on Feb. 6, 1997, now Pat. No. 5,800,290.

(51) Int. Cl.[7] ..... A63B 69/00

(52) U.S. Cl. ..... 473/438; 473/446; 473/447

(58) Field of Search ..... 473/438, 447, 473/439, 446, 448, 454, 455, 462, 101, 132, 459, 470, 471, 476, 477, 478, 479, 480, 423; 273/392

(56) References Cited

U.S. PATENT DOCUMENTS

| | | | | |
|---|---|---|---|---|
| 2,039,794 | | 5/1936 | Hayden | 273/1.5 |
| 2,085,206 | * | 6/1937 | Holdmdahl | 473/487 |
| 2,708,576 | | 5/1955 | Verkuilen | 273/1.5 |
| 2,964,316 | | 12/1960 | Rose | 273/26 |
| 2,978,246 | | 4/1961 | Van Groningen | 273/26 |
| 3,160,414 | | 12/1964 | Gray | 273/1.5 |
| 3,698,712 | | 10/1972 | Pero | 273/26 A |
| 4,206,915 | | 6/1980 | Woodcock | 273/1.5 A |
| 4,226,416 | | 10/1980 | Callanan | 273/1.5 A |
| 4,244,569 | * | 1/1981 | Wong | 473/447 |
| 4,506,886 | | 3/1985 | Lamb, Sr. | 273/1.5 A |
| 4,614,345 | * | 9/1986 | Doughty | 273/381 |
| 4,696,471 | | 9/1987 | McGrath et al. | 273/29 A |
| 4,842,283 | | 6/1989 | LeBel et al. | 273/392 |
| 4,911,442 | * | 3/1990 | Monroe et al. | 473/462 |
| 4,915,381 | | 4/1990 | Hackett | 273/1.5 A |
| 4,991,837 | | 2/1991 | Deal | 273/1.5 R |
| 5,160,138 | * | 11/1992 | Sanders | 473/438 |
| 5,354,048 | | 10/1994 | Winesberry, Jr. | 273/1.5 A |
| 5,390,912 | | 2/1995 | Silagy | 273/1.5 A |
| 5,433,434 | | 7/1995 | Helmetsie | 273/26 A |
| 5,558,323 | | 9/1996 | LoFaso, Sr. | 273/1.5 A |
| 5,603,495 | * | 2/1997 | Noveck | 473/447 |
| 5,628,515 | | 5/1997 | Levy | 473/446 |
| 5,800,290 | * | 9/1998 | Barry | 473/437 |
| 5,800,291 | * | 9/1998 | Grover | 473/447 |

* cited by examiner

*Primary Examiner*—Jeanette Chapman
*Assistant Examiner*—M. Chambers
(74) *Attorney, Agent, or Firm*—Pennie & Edmonds LLP

(57) ABSTRACT

An athletic shooting aid adapted to be detachably mounted directly on the goal of a sporting event to provide a target at which the player aims and strikes with the game piece in order to improve the form and accuracy of the player's shooting. The device comprises a clamp which is removably attachable to the goal having a substantially straight elongated member extending from the clamp with a ball or target of material attached to the elongated member to serve as the target at which the player aims when shooting the game piece. The elongated member is adapted and configured to allow the ball to move when struck by the game piece in such a manner that the game piece deflects the ball without substantially affecting the trajectory of the game piece and to allow the ball to be repositioned after the game piece has passed through the goal.

23 Claims, 8 Drawing Sheets

ATHLETE PRACTICE SHOOTING AID DEVICE

CROSS-REFERENCE

This application is a Continuation-in-Part of application Ser. No. 08/796,768 filed Feb. 6, 1997, now U.S. Pat. No. 5,800,290.

FIELD OF INVENTION

This invention relates to a shooting aid device connected to a goal, such as a basketball hoop, soccer goal, hockey goal, football goalposts, etc., having a target at which a player aims to improve his/her shooting form and accuracy.

BACKGROUND OF THE INVENTION

Various training devices have been designed in an attempt to improve the shooting accuracy of athletes in sporting events such as basketball, soccer, hockey, lacrosse, football, tennis, etc. At least two types of shooting aids have been proposed. The first type of shooting aid causes the game piece, i.e., the basketball, soccer ball, hockey puck, lacrosse ball, tennis ball, etc., to miss or deflect away from the goal when it is improperly shot thus allowing only highly accurate and desirable shots to score. The second type of shooting aid provides a visual target for the player to aim and shoot at when shooting at the goal.

One area in which many shooting aid devices have been attempted is basketball. One example of a basketball practice device which operates by deflecting shots with undesirable trajectories is U.S. Pat. No. 4,206,915 to Woodcock. This patent has as its principal object a device which will deflect shots having a flat trajectory and encourage shooters to place a higher arc or trajectory on a shot. The Woodcock device has a C-ring adapted to attach to the basketball hoop with a plurality of radially, laterally extending legs which extend outwardly from the hoop about four to six inches. A free-standing member is mounted on each leg which projects at least about two to four inches over the rim. The free-standing member is positioned to deflect basketball shots having undesirable trajectories. The object and purpose of the free-standing members are for the shooter to aim and shoot over the free-standing members so that the shooter develops a high arcing shot. The disadvantage of this device is that it does not provide a visual target or focus point for the player to aim at when shooting the basketball. A further disadvantage is that a shooter may improperly focus on and subconsciously aim at the free-standing member which will have the undesirable effect of teaching poor shooting. In addition, this device does not provide positive reenforcement when the player makes a proper shot, but rather it only indicates when the player has made an improper shot having a low, flat trajectory.

An example of the second type of shooting aid which provides a target is U.S. Pat. No. 4,244,569 to Wong which discloses a target in the form of a brightly colored ball which extends from the backboard at a position substantially immediately below and at the center of the basketball hoop. This apparatus has disadvantages in that the target is not easily visible in its position immediately below the rim and in the center of the hoop.

A differing example of the second type of practice shooting aid is U.S. Pat. No. 4,506,886 to Lamb, Sr. which discloses a basketball practice apparatus which extends from the backboard at a position above the rim and at the center of the hoop area. This basketball shooting apparatus has disadvantages inasmuch as the structure of the holding apparatus for the target impedes upon the utilization of the backboard and prevents utilizing the apparatus in a scrimmage or game situation.

Another example of the second type of shooting aid is U.S. Pat. No. 5,603,495 to Novek. In one embodiment, Noveck discloses two collars which fit together to form a torodial enclosure which is attached to the rim of a basketball hoop. A rod (pivot shaft) traverses an aperture formed in the side wall of one of the collars and two support arms connect adjacent to and extend substantially perpendicular from the ends of the rod (pivot shaft), a two-dimensional planar target attaches to and spans the distance between the two support arms and a spring positioned around the support arms (and retained by the collar) allows the target face to move and be repositioned. A second embodiment of Noveck discloses a similar rod (pivot shaft), support arm and target construction with a fastening device which attaches to the basketball rim and has a flange which extends from the structure in contact with the rim and forms an opening to receive and attach to the mid-section of the rod (pivot shaft). Noveck discloses that the target can be placed at an angle relative to the ground which can accommodate relatively flat or high-arched shots.

It is an object of the present invention to provide a practice device which can be attached to a basketball hoop and other sporting event goals and aids in teaching players proper aim and shooting/kicking techniques. It is a further object of the invention to present a visual target which displays a clearly visible aiming or focus point. It is a further object of the invention to provide positive feedback to the player so that the player can perceive when he/she has taken a proper shot. It is a further object of the invention that the target deflect upon impact with the basketball or other game piece in a manner which does not substantially deflect or alter the path or trajectory of the basketball or other game piece.

It is a further object of the invention that the device be configured and attachable to a basketball hoop or sporting event goal in a manner which does not interfere with play such that a scrimmage or game can be played with the target device attached to the hoop or goal. It is a further object of the invention to attach the device as unobtrusively as possible to limit the possibility of interrupting the trajectory of the basketball or game piece or the possibility of unexpected ricochet or bouncing. It is a further object of the invention to configure and adapt the device so that "dunking" of the basketball can still occur so that game-play can be as normal and realistic as possible. It is a further object of the invention to adapt and configure the device such that the possibility of hand injury during dunks or rebound tip-ins is minimized. It is a further object of the invention to configure the device so that it can attach to standard as well as non-standard or reinforced basketball hoops, common in public basketball courts.

It is a further object of the invention to provide positive feedback in the form of flashing or blinking lights, alone or in combination with a pleasing sound generated from an audio means.

It is a further object of the invention to attach the device to the hoop such that it does not damage the hoop or goal over time by marking or deforming the rim/goal or chipping the paint. It is also an object of the invention to provide a basketball practice shooting device for improving shooting accuracy which utilizes a target positioned above the front of the rim to present an unobscured aiming or focus point for the shooter. It is an object of the basketball shooting aid device to teach the shooter to place his/her shots just above the front of the basketball rim. It is a still further object that, while the device may be attached to the goal during scrimmage or game play, after consistent usage an image or illusion of the target should or may appear to the player without the target practice apparatus actually in place.

Other objects and advantages of this invention will become apparent from the following description taken in conjunction with the accompanying drawings wherein different embodiments are set forth by way of illustration.

SUMMARY OF THE INVENTION

This invention involves a practice device which can be mounted on a goal, for example the rim of a basketball hoop, a hockey goal, a soccer goal, football goalposts, a tennis net, etc., and used to improve the sighting, placing, shooting and ideally the scoring skills of a player. The device comprises a base or clamp adapted to mount to the aforementioned goal which has extending linearly therefrom an elongated member which has attached thereto at the end distal from the base a bulk or ball of material acting as a target. The bulk or ball of material acts as the target for the shooter to aim at when shooting. The elongated member is designed so that when the player hits the target, the bulk or ball of material will deflect away without substantially affecting or altering the trajectory of the game piece. By hitting the target, the player receives positive feedback and a sense of an accurate, proper shot. In addition, the device does not substantially affect or interfere with the play of the game by deflecting the shot off-course or intruding upon the play of the game.

DETAILED DESCRIPTION OF THE INVENTION

Figure 1:
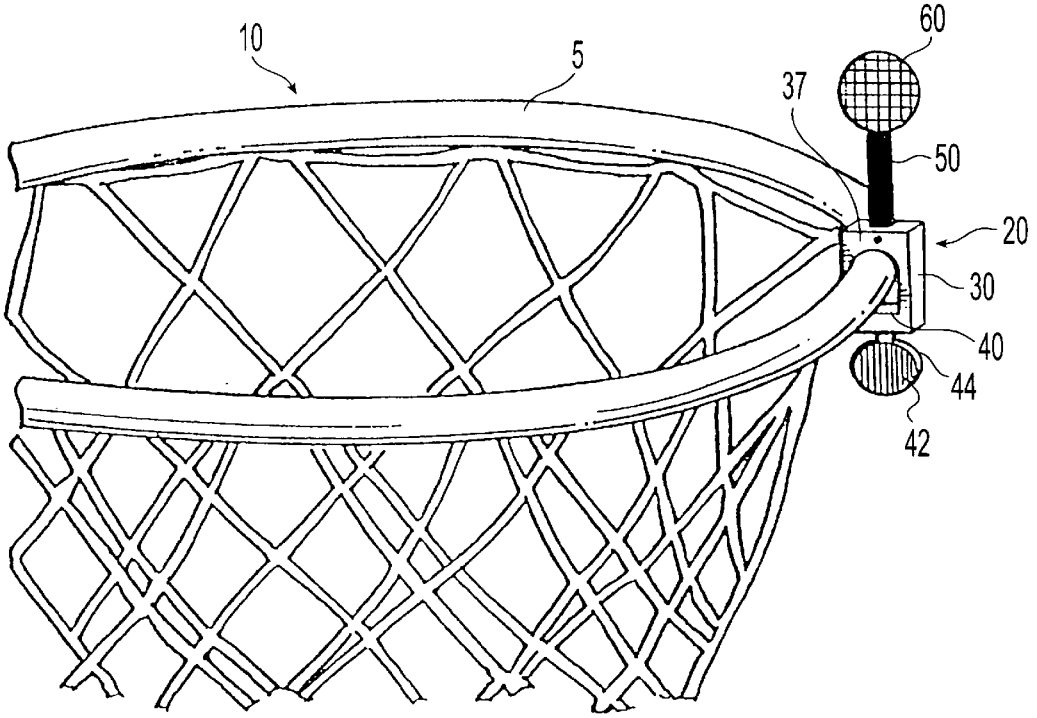
FIG. 1 illustrates a perspective view of the device according to the present invention mounted on the rim of a basketball hoop.

The device of the present invention will be explained primarily by reference to basketball. However the device has application in many sports and should not be limited to the specific device as adapted for basketball. Referring to FIG. 1, a standard basketball goal or hoop 10 is mounted on a backboard (not shown) by means of a conventional bracketing arrangement (also not shown). Mounted on the rim 5 of the basketball goal or hoop 10 is one embodiment of the device 20 of the present invention. The term "goal" as used herein depends upon the sporting event referenced and is used in a broad general sense to refer to a basketball hoop, a soccer goal, football goalposts, a hockey goal and/or a tennis net as well as the supporting structure such as goalposts, crossbars, uprights, etc. In a similar manner, "game piece" is used in a general sense to refer to the object which is being shot, aimed, thrown or hit. For example, in hockey, the game piece would be the hockey puck (or ball); in basketball, the basketball; in tennis, the tennis ball; etc.

Figure 2:
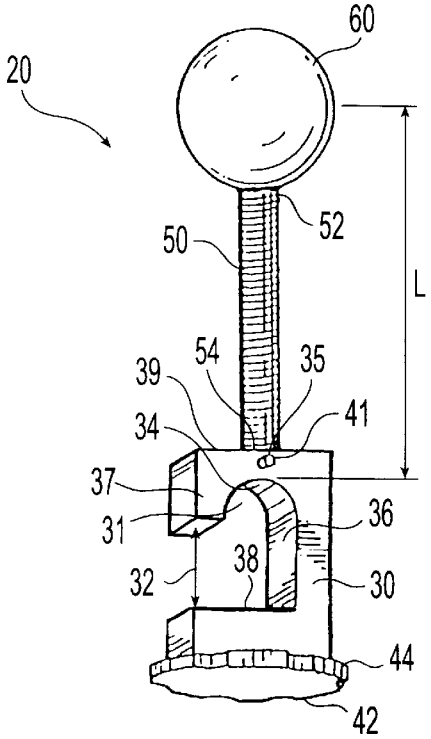
FIG. 2 illustrates a perspective view of a different embodiment of the device of FIG. 1.

Referring to FIGS. 1 and 2, the device 20 is attached to the basketball hoop 10 by means of a base or clamp 30. The elongated member 50 is attached at its first end substantially perpendicular to the clamp 30. Bulk member 60, is attached to the elongated member 50 at its second end opposite to the clamp 30 and provides a highly visible target for the shooter.

The bulk member 60 can be of any suitable size or shape, but preferably the bulk member 60 is spherical and has a diameter such that it is small enough not to interfere with game-play, but is large enough to be visible at a distance. Approximately one and one-half inches, for example, has been found to be one size that is suitable for basketball.

The bulk member 60 should be made of any material which has the requisite strength and durability characteristics such that it will not fail, break, crack or be damaged when repeatedly impacted by the basketball and, preferably, should not mar the basketball. A soft, deformable resiliently elastic material is preferred for the bulk member 60 and rubber has been found to be a suitable material.

The bulk member 60 preferably is brightly colored so as to be seen at a distance and should preferably be a different color than the elongated member 50 so that the bulk member stands out for the shooter and the elongated member fades into the background or is unnoticeable. The ball 60 may be configured into any suitable shape, and it is preferred that the ball 60 be sized, configured and colored to be highly visible. A spherical ball such as illustrated in FIGS. 1 and 2 made of rubber and sized to be larger than the elongated member 50 and colored differently than the elongated member 50 and, preferably, a bright color has been successful for basketball.

Figure 5:
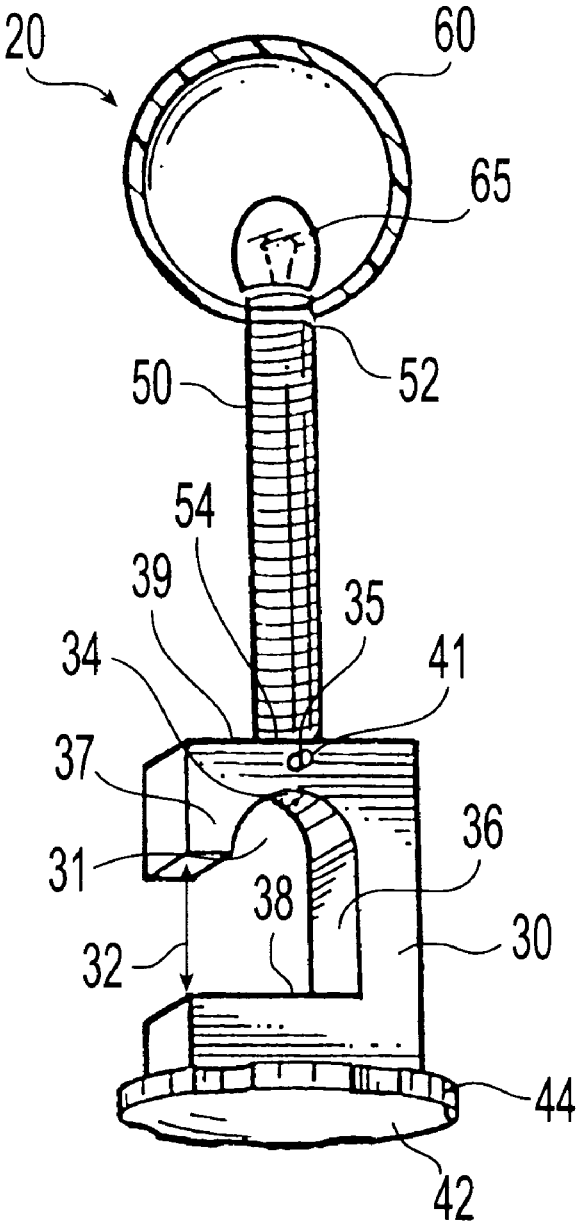
FIG. 5 is a perspective view of the device of FIG. 2 with a cross-section of the target member.

Alternatively, as shown in FIG. 5, the bulk member 60 may comprise a translucent shell which encases a light source 65. The light source 65 may be constant, or may flash or may be colored so as to be highly visible at a great distance.

The bulk or ball of material 60 is attached to the end 52 of the elongated member 50. The bulk member 60 may be attached to the elongated member 50 by any suitable means such as drilling a hole in the bulk member 60 and securing it onto the elongated member 50 by a force-fit, friction fit or, alternatively, using a screw, rivet, pin fastener or any like fastening device. Alternatively, the bulk member 60 may be connected to the elongated member 50 by bonding or gluing, and also may be formed integrally with the elongated member 50.

An elongated member 50 extends substantially straight from the clamp 30 without any major bends or curved portions. The elongated member 50 is made of resilient flexible material such that it will withstand the shock of flying game pieces and will deflect, flex or deform when the ball 60 is struck or impacted by a game piece in a manner which will allow the ball 60 to move or deflect out of the path of the game piece without substantially altering the game piece's trajectory. The elongated member 50 returns to its initial position after the game piece has passed so that the target returns to its original position after being struck by the game piece to reset for the next shot. The elongated member 50 is formed of a material and sized and configured to withstand the force and impact of the game piece of the sporting event for which the device 20 is designed. Examples of materials suitable for elongated member 50 include rubber, plastics, urethanes, coiled metal springs or a combination of these materials.

The clamp 30, when used to attach the device to a basketball rim, preferably has a modified C-shape which includes an opening 31 to allow the clamp to slide over the basketball rim 5 with an inner surface which has an arcuately-shaped upper portion 34 which rests on top of the rim 5, a straight back portion 36 and a flat straight bottom base portion 38. The opening 32 is approximately seven-eighths of an inch, the bottom base portion 38 approximately five-eighths of an inch, and the back portion 36 approximately five-eighths of an inch. The clamp 30 has a longitudinal axis which extends along the direction of the opening 32 shown in FIG. 2. The arcuately-shaped upper portion 34 has a radius of curvature which approximates the radius of curvature of the basketball hoop and is approximately five-sixteenths of an inch (five-eighths inch diameter). The arcuately-shaped upper portion 34 contributes to the formation of a flange or lip 37 which extends downwardly along the side of the basketball rim 5. The lip or flange 37 helps the clamp 30 grasp and remain on the basketball rim 5.

The bottom base portion 38 of the clamp 30 has a threaded hole 40 therethrough for receiving a set screw 42. The set screw 42 has machine threads which mate and interact with the machine threads formed in hole 40 to allow the screw 42 to be turned in order to press and hold the clamp 30 on the goal; in FIG. 1, the rim 5 of the basketball hoop 10. It can be appreciated that the threaded hole 40 can be formed in different location(s) on clamp 30 or holes in addition to threaded hole 40 can be formed in the clamp 30 to interact with the set screw(s) 42. The end 44 of the set screw 42 may have a plate (FIG. 1), circular knob (FIG. 2), or any other configuration which allows the set screw 42 to be turned. Preferably, the end 44 of the screw 42 is configured to allow the set screw 42 to be hand-tightened onto the goal 10. Alternatively, other fastening devices such as a spring-loaded pin can be utilized to retain clamp 30 on the rim 5 of the basketball hoop 10.

It is preferred that the clamp 30 be adapted and configured to be removably attached to all basketball rims including the older style and the new style which has a rounded edging of material underneath the rim and which is used to attach the net to the rim. In the newer style rim with the extra piece of rounded edging on the underside of the rim, it is advantageous to have a threaded hole 40 formed diagonally in the corner where the bottom base portion 38 and back portion 36 meet. The set screw or fastening device 42 then protrudes through the hole 40 and presses diagonally into both the rim and the rounded bottom edging. In this circumstance, lip 37 is advantageous because it retains the clamp 30 on the rim 5.

The clamp 30 may be made of any material which has the requisite strength and durability characteristics such that when it is hit by a game piece, it will not break, crack, fail or be damaged. An example of a suitable material is three-eighths inch steel, aluminum or plastic machined or molded to have an opening 31 as described above or any other configuration which will allow its attachment onto the goal. In the case of FIGS. 1 and 2, basketball hoop 10.

The elongated member 50 may be attached to clamp 30 by any appropriate means such as for example a pin fastener, rivet or screw. In the embodiment of FIG. 1, a hole 54 (not shown) is formed through elongated member 50 which mates and communicates with a hole 35 in clamp 30 and a pin 41 is inserted which extends through holes 35 and 54 to hold elongated member 50 to clamp 30. The elongated member 50 also may be bonded or glued to the clamp 30.

When device 20 is configured for use with a basketball hoop 10, the elongated member 50 and ball 60 are configured so that distance "L" shown in FIG. 2 is approximately two to approximately four inches so that when the device 20 is placed on the rim 5, the ball 60 forming the target is approximately two to approximately four inches directly above the rim. In the embodiments shown in FIGS. 1 and 2, elongated member 50 is approximately one and one-half inches long, cylindrical in shape with a half-inch diameter and made of black neoprene rubber having a durometer of 70A. The ball 60 is spherical in shape with a one and one-half inch diameter and is made of bright yellow rubber having a softer durometer than the elongated member 50.

When using the device 20 for basketball, it should be placed on the front of the rim 5 so that the shooter aims at the target member 60 which is positioned directly above the front of the rim 5. When shooting a basketball, a player aims for and shoots at the ball 60 forming the target member. The ball 60, which is approximately two to four inches and, more preferably, approximately three inches higher and directly above the front of the rim 5 not only will give the shooter a highly visible target but will teach the art of shooting over the front of the rim, not at it. The shooter using the device 20 over time will develop a sense of where and how to shoot the basketball and greatly improve his/her shooting skills. In fact, in time and with enough use, the shooter will be able to mentally visualize the target even when the device 20 is not actually attached to the hoop.

Figure 3:
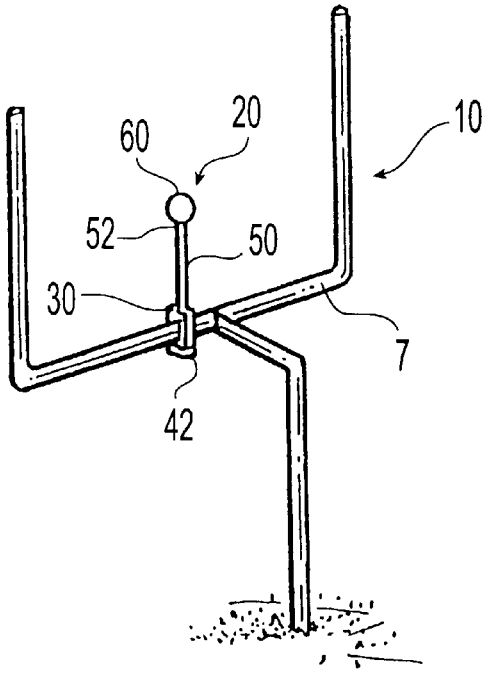
FIG. 3 is a perspective view of a different embodiment of the invention mounted on a football goalpost.

Referring to FIG. 3, device 20 has been dimensioned, configured and adapted for a football player kicking field goals. The clamp 30 and its openings 31 and 32 are dimensioned and configured to attach to a football field goalpost. An opening 32 of four to five inches should be suitable. In this embodiment, the dimension "L" shown in FIG. 2 will be adapted specifically for kicking field goals and may be from about one to about twelve feet and preferably from about six to about nine feet in order to place the bulk of material or target member 60 in a location above the horizontal bottom goalpost 7 which is suitable for kicking field goals. The elongated member 50 preferably may be adjustable in length so that the bulk of material 60 can be properly adjusted for kicking field goals and also easily collapsible for transport. The size of the bulk of material 60 may be increased as compared to the embodiment used for basketball, for example to a sphere having a one-foot diameter, and its shape changed to provide a more visible target for the field goal kicker. The diameter (width) of elongated member 50 is also sized in this embodiment to account for the added length and increased size of the bulk material 60.

The elongated member 50 of the embodiment used for football may be resiliently flexible such that it bends when it or the target 60 is struck or alternatively the connection of the elongated member 50 to the clamp 30 may be such that elongated member 50 moves in a manner which does not materially alter the trajectory of the football when the elongated member 50 or target member 60 is struck by the football. Elongated member 50 may be formed of rigid tubular sections which may be connected to a spring or resilient flexible materials connected together. Alternatively, or in addition to, telescoping concentric cylinders of material may be used for elongated member 50.

The device 20 of FIG. 3 provides a target or focus for the field goal kicker to aim at as opposed to an empty area between the two uprights of a goalpost. In this manner, the field goal kicker will obtain a sense of where to aim when kicking and will improve his/her kicking accuracy and skills. After obtaining the sense of where to aim, the kicker will be able to kick more accurately even when the device 20 is not in place because of the mental image retained by the kicker.

Figure 4:
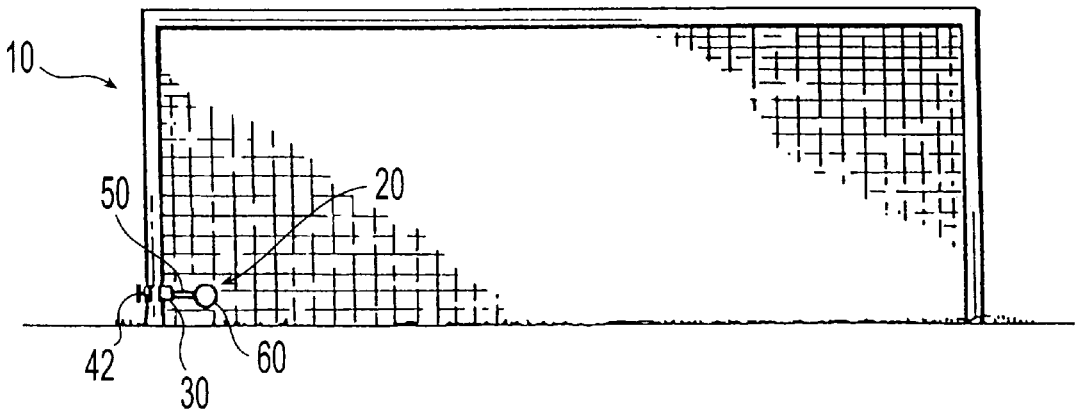
FIG. 4 is a perspective view of a different embodiment of the invention mounted on a soccer goal.

Referring to FIG. 4, the device 20 has been configured and adapted for attachment to a soccer goalpost. In this embodiment, clamp 30 is configured and adapted to attach to a goalpost or crossbar of soccer goal 10. The shape of the opening 31 in clamp 30 may be configured specifically to fit a crossbar or goalpost having a square cross-section as is sometimes provided with soccer goals. The elongated member 50 and ball 60 are configured and adapted to place the ball 60 within the plane formed by the goalposts and the crossbar and at a location approximately one foot from the end surface 34 of the clamp 30. The materials of elongated member 50 and bulk of material 60 are chosen so that they can withstand the shock of flying soccer balls. In use, the device 20 may be placed in the lower corners or any other desirable location of the soccer goal to provide a target for the shooter.

Again, by providing a target for the player to aim at instead of an empty space between goalposts and crossbars, the player develops a feel and a sense of where to aim when shooting at the goal and improves his/her shooting ability. After using the device 20 for a period of time, the player should be left with a metal impression of the target and, thus, be able to improve his/her accuracy even when the device is not actually connected to the goal.

It can be appreciated how device 20 can be adapted for a hockey goal, lacrosse goal and other sports where shooting accuracy comes into play. The device 20 likewise can be adapted for use in tennis, for instance by attaching it to the net or supporting structure of the net and placing the bulk of material or target member 60 several inches above the net thus providing the tennis player with a target to aim at when hitting (serving or returning) the tennis ball.

A further embodiment of device 20 includes using a light and, preferably, a flashing light as the target member 60 or incorporating a light 65 and, preferably, a flashing light 65, as shown in FIG. 5, into the bulk member 60 so that the target is highly visible. This feature is particularly advantageous for those sports where the goal is at a distance from the player.

An advantage of device 20 is that it can be used during practice drills, scrimmages or games without substantially interfering with the game. Because of its simple construction and direct attachment to the goal, the game will be substantially unaffected by its use. In addition, because it readily can be attached and detached to the goal, the device 20 can be removed easily or set up depending upon the player's desire.

Figure 6:
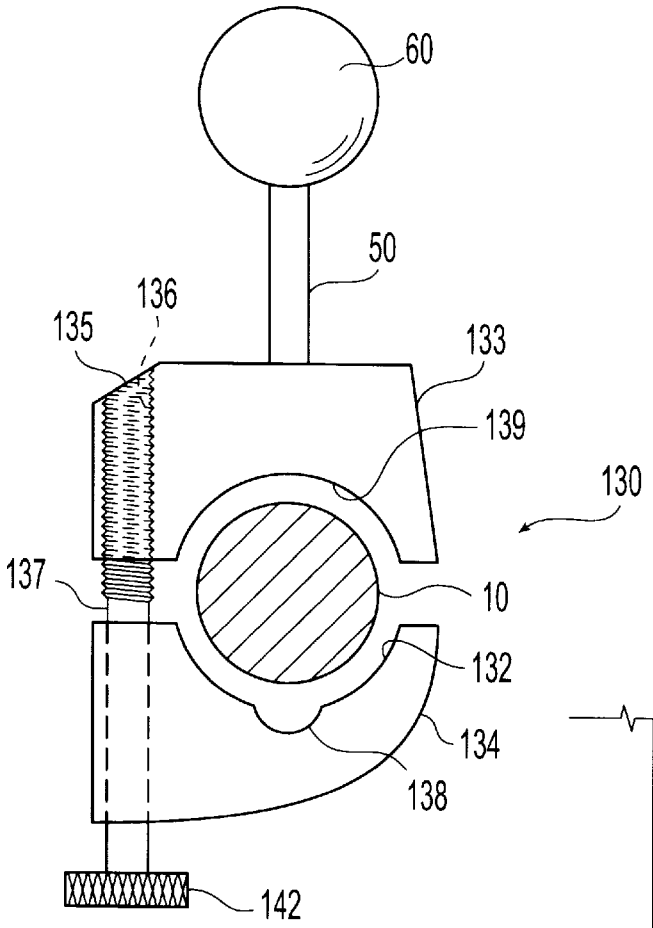
FIG. 6 is a cross-section of a device according to the present invention.

FIG. 6 shows a different embodiment of the clamp. The clamp 130 is a modified vise-clamp with an upper jaw 133 and a lower jaw 134. Upper jaw 133 can be attached to elongated member 50 as described above. Upper jaw 133 has an arcuate section 139, with a radius configured to rest on the basketball hoop 10 and provide a tight grip when the lower jaw 134 is engaged. A bore 135 is formed in upper jaw 133 that has a threaded portion 136. The lower jaw 134 has a arcuate section 132 with a radius that creates a tight fit with the basketball hoop 10 when the lower jaw 134 is engaged with the upper jaw 133. An arcuate section 138 is configured to accommodate netting or a netting clip, in the event that the device's desired location along the circumference of the hoop 10 contains such an obstacle, without reducing the tightness of the fit and without marring the device or the hoop 10. Set screw 137 is preferably rotatably attached to lower jaw 134 and is threaded to cooperate with the threads 136 in bore 135. A knob 142 is attached to the end of the set screw 137 to allow for hand tightening and loosening of the device. In the alternative, the knob 142 may be replaced with a tab or wing-nut configuration, or may be replaced with a screw head.

Once the desired position of the device is determined, the device rests on hoop 10 by means of arcuate section 139 on upper jaw 133. Lower jaw 134 is engaged by inserting the set screw 137 into bore 135 and turning knob 142 until clamp 130 forms a tight grip on hoop 10.

The clamp 130 should be made of a material that is durable enough to withstand the repeated impact of a basketball, but should not damage or mar the basketball. Examples of suitable materials are steel, aluminum or plastic. The upper jaw 133 and the lower jaw 134 must separate, in the open position, at least approximately five-eighths of an inch wide so as to allow the hoop 11 and any possible netting or netting clip to pass between. Preferably, this distance is wider so as to accommodate the non-standard hoops and reinforced hoops common to most public basketball courts.

Figure 7:
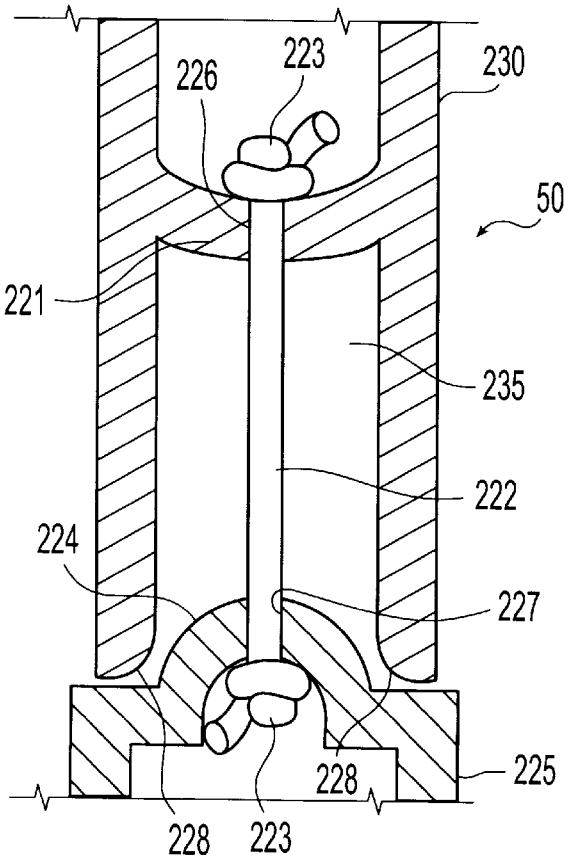
FIG. 7 is a cross-section of an elongated member of a different embodiment of the present invention.
Figure 8:
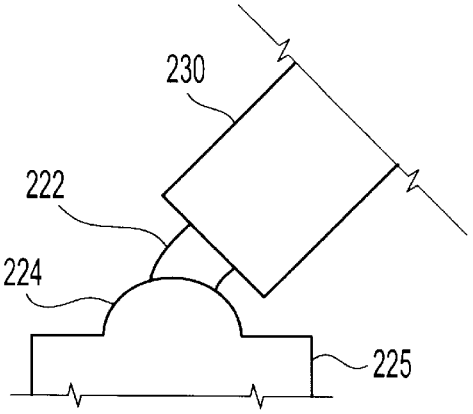
FIG. 8 is the elongated member of FIG. 7 in a break-away position.

In a different embodiment, as illustrated in FIGS. 7 and 8, the elongated member 50 may be attached to the clamp 30 in a manner which allows it to move, pivot or deflect when the ball 60 is struck by the game piece so that the ball allows the game piece to pass without substantially affecting the trajectory of the game piece. After the game piece has deflected the ball 60 and passed through the hoop, the elongated member 50 returns to its original position to reset the target (ball 60) for the next shot.

In FIG. 7, elongated member 50 comprises shell 230 which is attached to the bulk member (not shown) at one end and has a hollow cavity 235. Inside cavity 235, a crosspiece 221 with hole 226 supports one end of a tube or strip 222. The strip 222 may be resilient such as, for example, what is referred to as a "bungee cord" or a spring or rubber insert.

The resilient strip 222 is prevented from passing through hole 226 by way of a knot 223. Alternative fasteners such as a pin, tab or washer may be utilized in lieu of the knot 223. The opposite end of strip 222 passes through hole 227 in dome 224. Dome 224, which in this example is hemispherical, can be formed integral with clamp 225 (shown, in part) or may be affixed to clamp 225 by any suitable means. Shell 230 has contours 228 configured and adapted to cooperate with dome 224. The strip 222 is also prevented from passing through hole 227 by way of a knot 223, or alternatively, as above with a pin, tab, washer or other suitable fastener.

It is preferable that when utilizing this embodiment of the elongated member 50, that bulk member 60 (not shown) be attachable to the elongated member 250 such that the strip 222 can be easily replaced by the user in the event that it breaks. Likewise, dome 224 is preferably attachable to the clamp 225.

The elongated member of this embodiment can be made from metal, plastic or rubber or combinations thereof providing it can withstand repeated impact by a basketball. One example of the elongated member of this embodiment is one and one-half inches in length and has a diameter of approximately one-half inch.

In its initial or home position (as shown in FIG. 7) the shell 230 is seated upon the dome 224. The resilient strip 222 is under slight tension. When the bulk member (not shown) is struck by the basketball, the shell 230 is deflected and/or displaced from the home position to a breakaway position (shown in FIG. 8).

In a break-away position. The shell 230 is no longer seated on the dome 224, but may be (depending upon the force of the impact and the resiliency of the strip 222) still in contact with the dome 224. When displaced to a breakaway position, the strip 222 is under a greater tension than its tension in the home position. When the basketball ceases to act on or make contact with the bulk member (not shown) this increased tension will pull the shell 230 and the bulk member (not shown) back toward the home position as shown in FIG. 7. The dome 224 is configured and adapted to cooperate with contours 228 and ensures that the shell 230 and bulk member (not shown) will realign automatically for the next shot. The resiliency of the strip 222 is such that the elongated member will deflect without altering the trajectory of the basketball.

Figure 9:
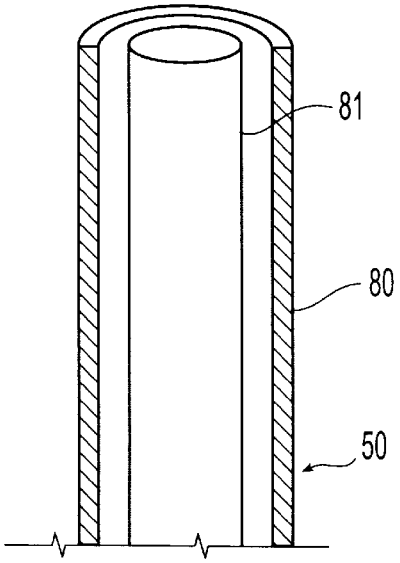
FIG. 9 is a cross-section of a different embodiment of an elongated member according to the present invention.

A different embodiment of the elongated member is illustrated by FIG. 9. The elongated member 50, in this embodiment, comprises a shell 80 and an insert 81. Both shell 80 and insert 81 may be resiliently flexible or the insert alone or shell alone may be resiliently flexible. The resiliency of the shell 80 and the insert 81 are such that the combination deflects when the bulk member (not shown) is struck by the basketball such that the basketball's trajectory is not substantially altered and returns the bulk member (not shown) to its original position. The shell 80 may be made of the same materials as the bulk member (not shown) and the shell and the bulk member may be formed integrally. The shell 80 and insert 81 can be formed of rubber, plastic, a coiled metal spring, or any other suitable material.

In one embodiment of FIG. 9 which has shown promise, the insert 81 is wire and the shell 80 is a rubber or plastic coating applied directly onto and over the wire, such as, for example, plastic covered cable wire. The wire may be in the form of multiple wires which may be stranded together. The wire may be formed of steel or other metals, such as, for example, copper or aluminum, while the coating may be rubber, urethanes, polyethylenes, polyamides, etc. One exemplary shell and insert combination which shows promise for basketball has numerous bundles of 20-gauge steel wire bundled and stranded together to form a core insert of approximately one-eighth of an inch coated with clear polyethylene for a total diameter of approximately one-quarter of an inch. These dimensions and materials are exemplary only and the thickness, dimensions, and configuration of the shell and insert depends upon the material selected and the sporting event for which the device is intended.

The shell 80 can be attached to the clamp (not shown) by means of a force-fit, friction fit, screw, pin, rivet or any other suitable fastening means. The insert may be attached to the shell 80 or may be attached to the clamp (not shown) or attached to bulk member or any combination thereof. In the alternative, the insert 81 may float freely inside the shell 80. In the alternative, the insert 81 may be omitted.

Figure 10:
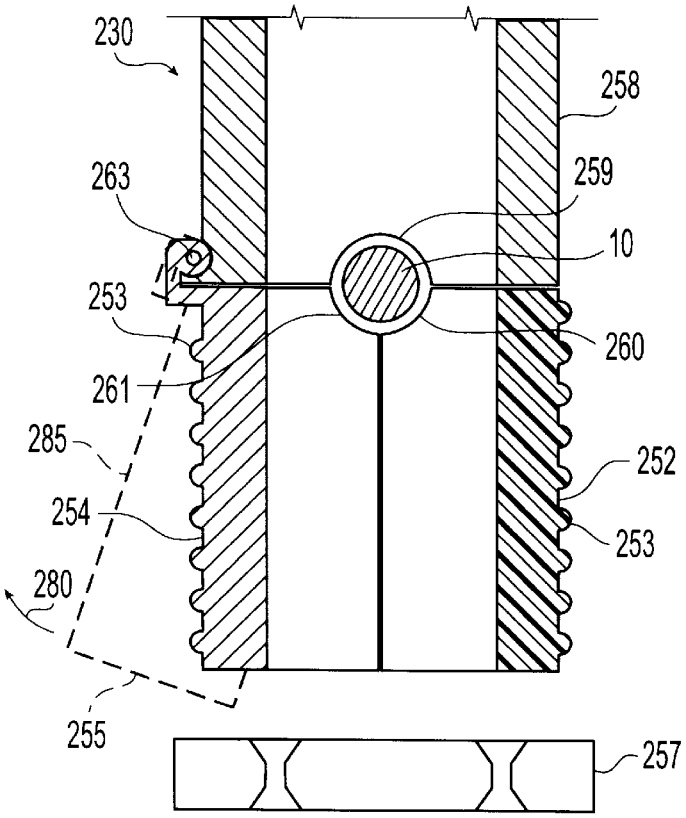
FIG. 10 is a cross-section of a clamp according to the present invention.

Referring to FIG. 10, a different embodiment of the clamp of the device is shown. Clamp 230 is formed by two legs 252 and 254 which append from a body portion 258 each having an arcuate portion 260, 261 and 259 respectively. Arcuate portions 259, 260 and 261 are configured and adapted to cooperate and communicate so as to form a tight grip on the basketball hoop 10. Leg 252 is immobile. Leg 254 is mobile such that it can be swung in the direction of arrow 280 to an open position 255 (shown by the dotted lines 285) and be swung to a closed position (as shown). Leg 254 is attached to body 258 by means of a pin hinge assembly 263 or, alternatively, by means of a living hinge. In an alternative embodiment, both legs 252 and 254 may be attached to body 258 by means of a hinge. Both legs have threads 253 which are designed to cooperate and communicate with a tightening nut 257. The base portion 258, the right leg 252 and the left leg 254 can be formed from metal, rubber, or plastic.

To attach the device, leg 254 is swung into the open position 255 and the clamp 230 is passed over the hoop 10 such that arcuate portions 259 and 260 of this clamp 230 contact the hoop 256. Leg 254 is then swung into the closed position (as shown). Tightening nut 257 which is threaded to cooperate and communicate with threads 253 is rotated onto legs 252 and 254 to keep them from separating and to form a tight grip on hoop 10.

Figure 11:
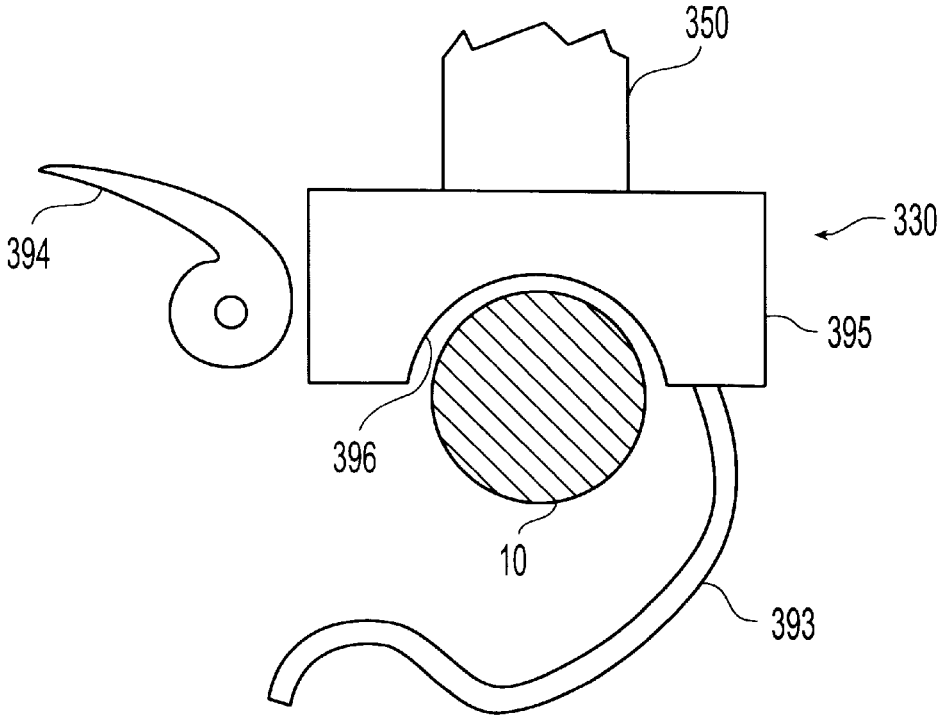
FIG. 11 is a cross-section of a different clamp according to the present invention.

Referring to FIG. 11, a different embodiment of the clamp is shown. Clamp 330 is connected to elongated member 350 (shown in part). Clamp 330 has a base portion 395 having an arcuate section 396 configured and adapted to receive and grip the basketball hoop 10. Appended to the base 395 is a fabric strap 393. A locking cam 394 is attached to the side of the base 395 opposite to the location where the fabric strap 393 is connected to the base 395. The locking cam 394 is shown in its open position.

Figure 12:
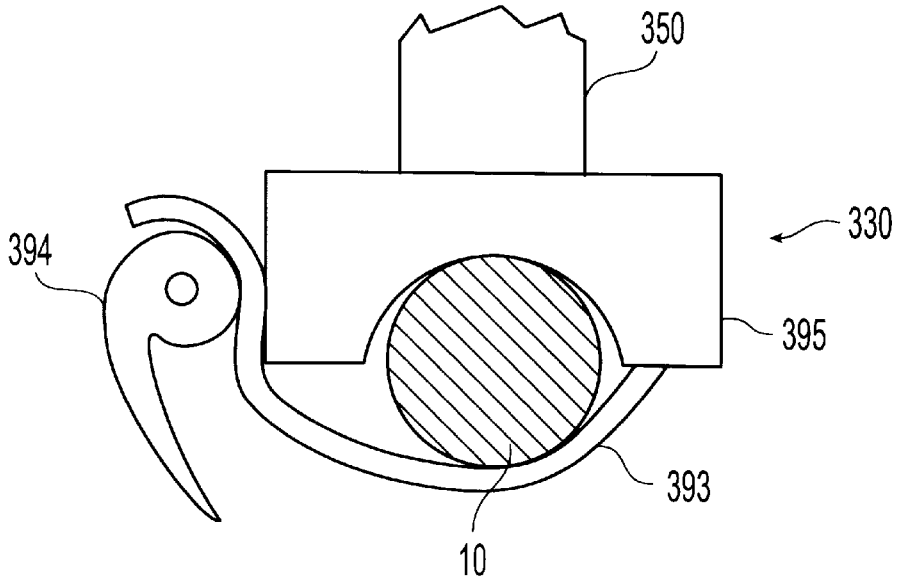
FIG. 12 is a cross-section of the clamp of FIG. 11 in its locked position.

Referring to FIG. 12, the embodiment of FIG. 11 is shown attached to basketball hoop 10. The fabric strip 393 has been looped around the basketball hoop 10 below the base 395 through cam 394. Cam 394 then depresses into its locked position as shown to hold the strap 393 tightly in place against the basketball hoop 10 so that the clamp 330 does not rotate or displace relative to the basketball hoop 10 when the bulk member (not shown) is struck repeatedly by the basketball.

Figure 13:
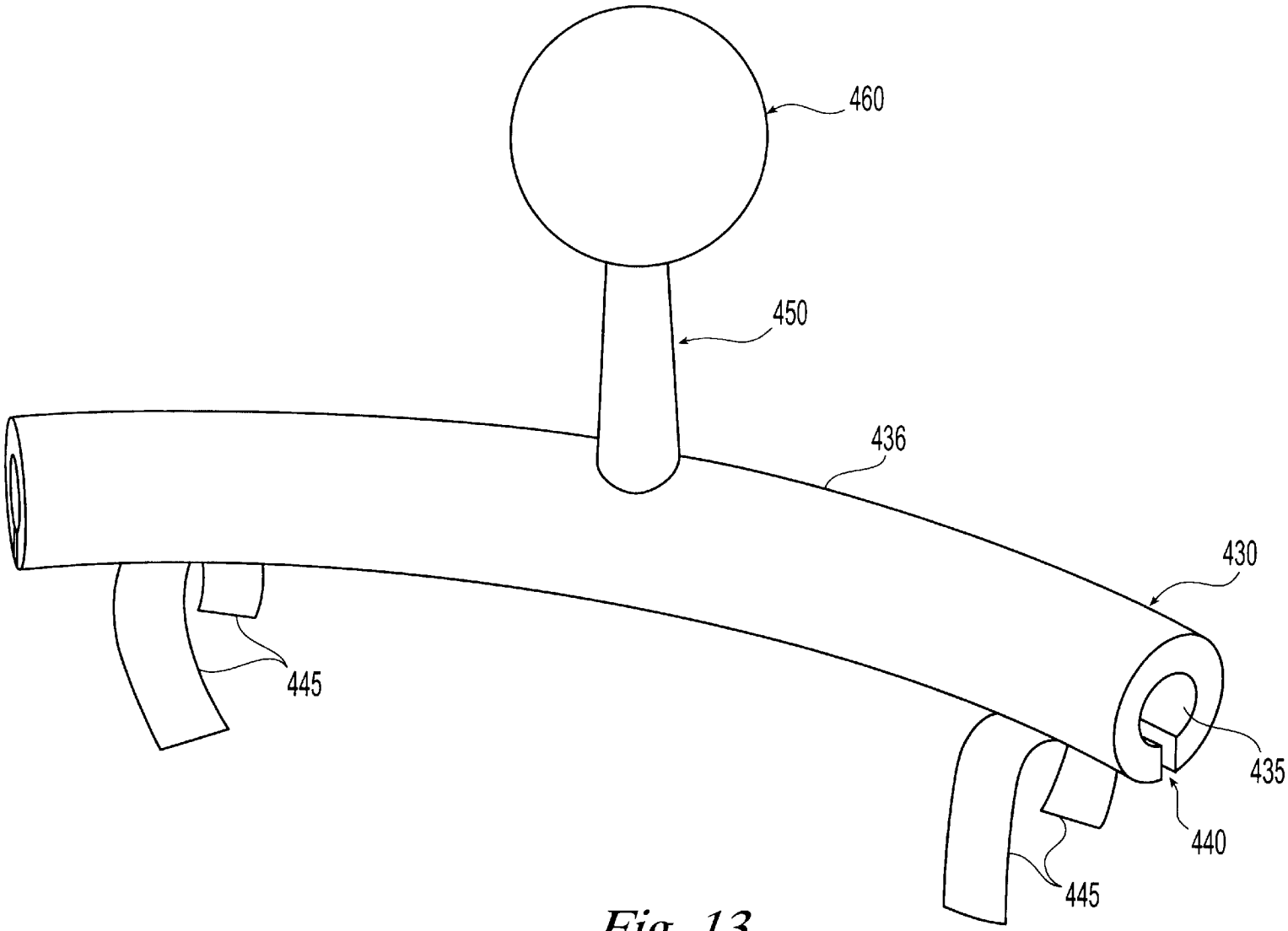
FIG. 13 is a perspective view of a different clamp according to the present invention.

Referring to FIG. 13, the clamp is formed from a flexible tubular member 430 which may be curved or straight. The tubular member 430 has an inner surface 435 adapted to receive and grip the hoop (not shown). The tubular member 430 has a longitudinal slit 440. Elongated member 450 is attached to the outside surface 436 of the tubular member 430 and extends perpendicularly from the outside surface. The bulk member 460 is attached to the opposite end of elongated member 450. The slit 440 is spread apart and depressed upon the upper surface of a basketball hoop as tubular member 430 is simultaneously bent into place. The length of the tubular member 430 is less than the circumference of the basketball hoop and preferably 3–10 inches. The outer surface 436 of the tubular member 430 is preferably colored a similar red orange as standard basketball hoops. The inner surface may be tacky, or roughed with grooves or bumps to enhance the grip or friction fit of the tubular member 430. Velcro straps 445 may be attached to the tubular member 430 to assist and enhance the gripping force of the tubular member 430 on the rim to prevent the device from rotating. In a further embodiment, a plurality of elongated members with attached bulk members may spaced along the length of the clamp, approximately one hand width apart or greater to allow for "dunking."

The tubular member 430 may be formed of rubber or plastic and may be reinforced with metal, plastic or rubber. The tubular member 430 may be formed from a plurality of layers or plies. The tubular member 430 must be flexible to depress onto and grip a basketball hoop but retain enough torsional stability so that the elongated member 450 and the bulk member 460 do not rotate or displace relative to the basketball hoop.

Figure 14:
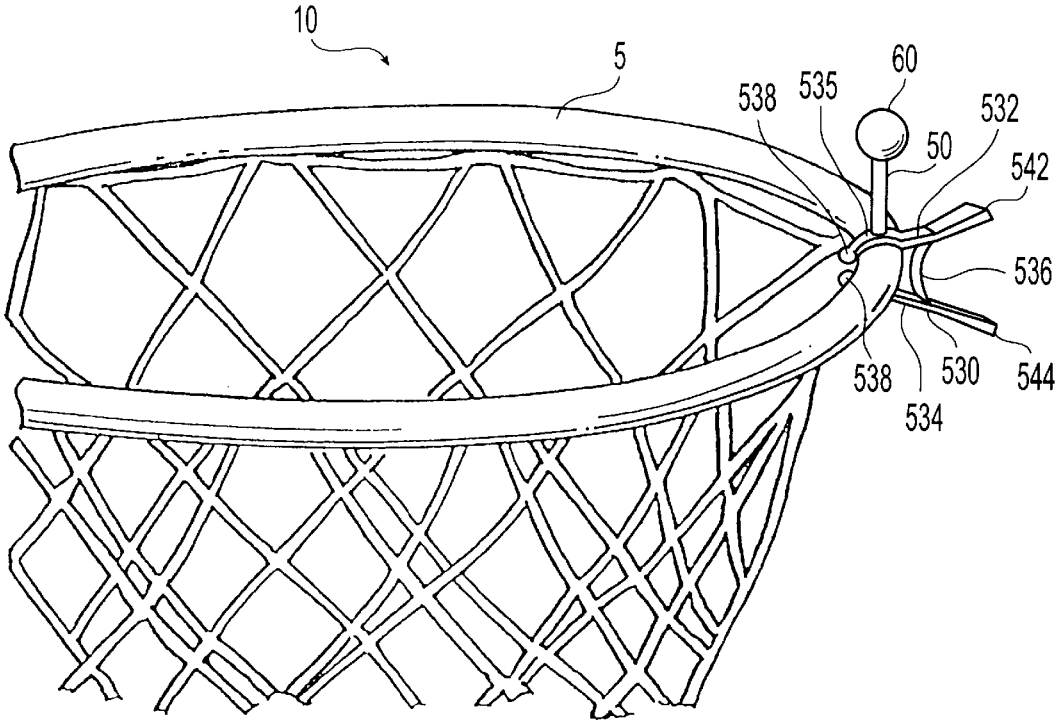
FIG. 14 is a perspective view of a further different clamp according to the present invention.

FIG. 14 shows yet a different embodiment of the clamp. Clamp 530 comprises a resilient clip having two legs 532, 534 connected by a flexible connecting member 536. Flexible connecting member 536 biases the legs 532, 534 together to exert a force on the rim when it is held between the legs. Flanges or protruding bumps 538 may be provided on the end of legs 532, 534 to help prevent the clamp 530 from slipping off of the hoop or rim. Handles or leg extensions 542, 544 may be provided on each of legs 532, 534 respectively. The handles 542, 544 are squeezed together by the user in order to flex flexible connecting member 536 to spread open legs 532, 534 to slip the clamp 530 over the basketball rim. Releasing handles 542, 544 closes clamp 530 down on the basketball hoop. Legs 532, 534 may be provided with arcuate sections 535 to assist in holding legs 532, 534 on the basketball hoop. The inner surface of the legs and particularly the arcuate sections may be tacky or roughened with grooves or projections to further enhance the grip or friction-fit of clamp 530. Handles 542, 544 may be hinged to fold away and be unobtrusive after the clamp 530 has been attached to the basketball rim. The handles 542, 544 can be squeezed together to remove the shooting aid from the basketball hoop. The elongated member 50 may be attached to the upper leg 532 of clamp 530 by any of the methods described earlier. The clamp 530 may be made of any number of materials including aluminum, steel or plastic so long as the connecting member 536 is stiff enough to provide enough force to legs 532, 534 to retain the clamp in place. Legs 532, 534 should be formed of, sized and configured such that they do not substantially deform under the force applied by the flexible connecting member 536.

Figure 15:
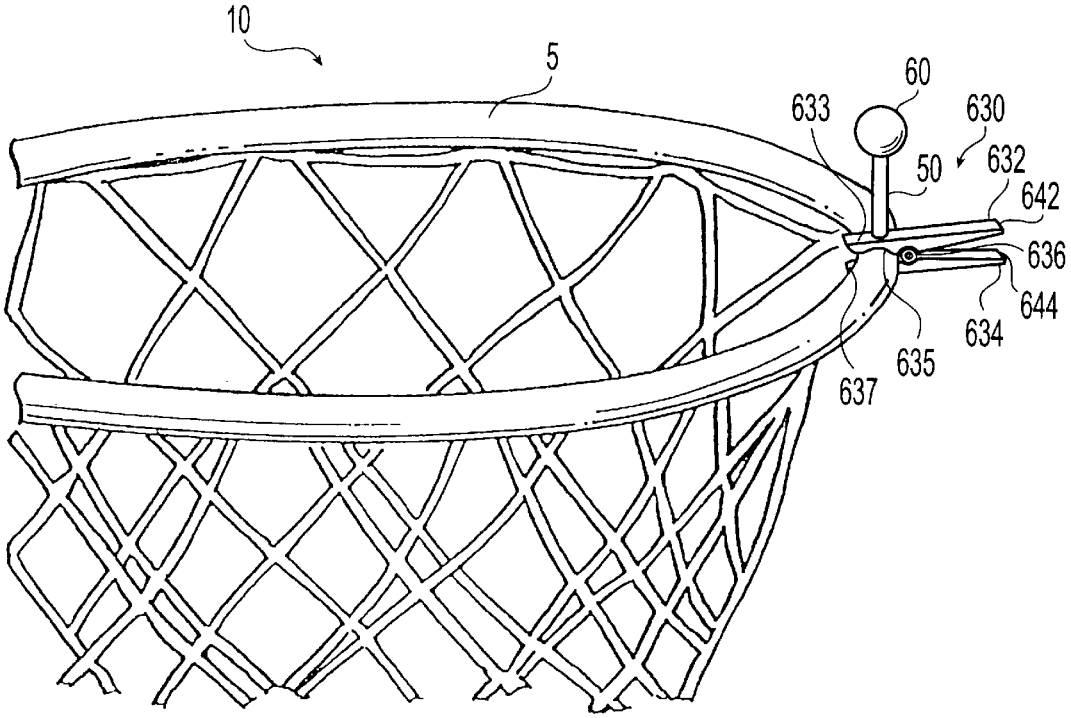
FIG. 15 is a perspective view of a different clamp according to the present invention.

FIG. 15 shows a clamp resembling a conventional clothes pin which is similar to clamp 530 of FIG. 14. Clamp 630 in FIG. 15 has two legs 632, 634 which have arcuate sections 535 which are configured to grip and attach to the basketball rim 5. Legs 632, 634 are connected by a spring 636 so that end 633 of leg 632 is biased into contact with end 637 of leg 634. Legs 632, 634 have handles or leg extensions 642, 644 which a user squeezes together to overcome the force applied by the spring 636 to open the ends 633, 637 to slip the clamp over the basketball rim 5. Handles 642, 644 are released so that clamp 630 engages and holds the clamp 630 on rim 5. Spring 636 is designed to provide enough force so that legs 632, 634 engage the rim 5 so that it does not rotate or move when the target 60 is hit with the basketball. Arcuate section 635 may be provided with grooves or projections to enhance the clamp's grip on the hoop. Legs 632, 634 can be made of metal, plastics or other materials so long that they have the requisite strength so as not to deform substantially over time so that the gripping force is not diminished and so it can withstand the impact of flying basketballs. Legs 632, 634 may be provided with hinges or other means to allow handles 642, 644 to be moved out of the way after the clamp is attached to the rim.

Although particular embodiments of the invention have been described and illustrated herein, it is recognized that modifications and variations readily may occur to those skilled in the art and, consequently, it is intended that the claims be interpreted to cover such modifications and equivalents.

I claim:

1. A device attachable to a sporting event goal for improving the accuracy and shooting form of a player by providing a visual target to aim at and strike with the sporting event's game piece comprising:

a clamp having an inner surface which contacts the sporting event's goal and an oppositely facing exterior surface, the clamp configured and adapted to removably attach to the sporting event's goal;

a substantially straight elongated member having first and second ends, the elongated member connected adjacent its first end to the clamp and extending substantially perpendicular from the exterior surface of the clamp such that its second end is located at a point distal from the clamp; and a three-dimensional target member connected adjacent the second end of the elongated member to form a target for the player to aim and attempt to strike with the game piece, wherein the elongated member is configured and adapted such that it (a) deflects when the target member is struck by the game piece so that the target member moves without substantially altering the trajectory of the game piece and (b) returns the target member to its original position after it has been deflected by the game piece.

2. The device of claim 1 wherein the elongated member at least partially is made of a resiliently flexible material such that it will (a) bend in order to displace the target member when the target member is struck by the game piece in a manner which allows the game piece to pass by the target member without substantially altering the trajectory of the game piece and (b) unbend to its substantially straight configuration to return the target member to its original position.

3. The device of claim 2 wherein at least a portion of the elongated member is made of rubber.

4. The device of claim 2 wherein the elongated member at least partially is formed by a coil spring.

5. The device of claim 1 wherein the elongated member is fixedly connected to the clamp in a non-adjustable manner.

6. The device of claim 2 wherein the target member is a different color than the elongated member.

7. The device of claim 6 wherein the target member is attached at the distal end of the elongated member.

8. The device of claim 1 wherein the target member includes a light.

9. The device of claim 8 specifically adapted and configured to attach to a soccer goal wherein the elongated member is adapted and configured to place the target member in the range of approximately one foot from the goal post or cross-bar.

10. The device of claim 1 wherein the elongated member has a hollow cavity.

11. The device of claim 10 wherein the hollow elongated member further comprises a resilient insert.

12. The device of claim 11 wherein the resilient insert is a bungee cord.

13. The device of claim 1 wherein the elongated member comprises coated wire.

14. The device of claim 1 wherein the clamp comprises:

upper and lower jaws configured and adapted to cooperate and communicate to grip the basketball hoop;

an adjustable set screw wherein the upper and lower jaws are movable about the basketball rim so that the device may be removably attached to the rim by rotating the set screw.

15. The device of claim 1 wherein the clamp comprises:

a base portion configured and adapted to cooperatively receive and grip a basketball hoop;

a first leg portion configured and adapted to cooperatively receive and grip a basketball hoop and fixedly attached to said base portion;

a second leg portion configured and adapted to cooperatively receive and grip a basketball hoop and to rotatably attach to said base portion having an open position to allow a basketball hoop to pass between the base portion, and first and second leg portions for cooperatively receiving the basketball hoop, and a closed position for gripping of and attachment to the basketball hoop; and a tightening nut configured and adapted to hold and press together the first and second leg portions of the clamp so that the clamp grips and attaches to the basketball hoop.

16. The device of claim 1 wherein the clamp further comprises a tubularly-shaped member of flexible material defining a channel running the length thereof configured and adapted to fit over and attach to a basketball rim, the tubular member having a slit running the length thereof and configured and adapted to allow the tubularly-shaped member to fit over the rim.

17. The device of claim 1 wherein the clamp comprises two legs configured to attach to the sports goal and connected by a flexible connecting member, the flexible connecting member biasing the legs into a closed position wherein the legs attach to the sports goal.

18. A basketball shooting aid device attachable to a basketball rim for the improving accuracy and shooting form of a basketball player by providing a visual target to aim at and strike with the basketball comprising:

a clamp having a tubularly-shaped unitary member of flexible, resilient material defining a channel running the length thereof configured and adapted to fit over and attach to a basketball rim, the tubular member having an inner surface which is configured and adapted to fit over and come into contact with the basketball rim and an opposite exterior surface, the tubular member having a slit along the length thereof, the slit configured and adapted to allow the spreading of the tubular member so that it may fit over the rim;

a substantially straight elongated member having first and second ends, the elongated member connected adjacent its first end to the tubular member and extending substantially perpendicular from the exterior surface of the tubular member such that its second end is located at a point distal from the clamp; and a target member connected adjacent the second end of the elongated member to form a target for the player to aim and attempt to strike with the game piece, wherein the elongated member is configured and adapted such that it (a) deflects when the tubular member is struck by the basketball so that the target member moves without substantially altering the direct trajectory of the basketball and (b) returns the target member to its original position after it has been deflected by the basketball.

19. The device of claim 18 wherein the elongated member comprises a bundle of steel wires coated by a plastic material.

20. A device attachable to a football field goal post for improving the accuracy and kicking form of a football player by providing a visual target to aim at and strike with a football comprising:

a clamp having an inner surface which contacts the football field goal post, the clamp configured and adapted to removably attach to the football goal post;

a substantially straight elongated member having first and second ends, the elongated member connected adjacent to its first end of the clamp and extending substantially perpendicular from the clamp such that its second end is located at a point distal from the clamp, the elongated member formed of a stranded wire coated with a plastic material; and a target member connected adjacent the second end of the elongated member to form a target for the player to aim and attempt to strike with the football, wherein the elongated member is configured and adapted such that it deflects when the target member is struck by the football so that the target member moves without substantially altering the trajectory of the football and returns the target member to its original position after it has been deflected by the football.

21. A device attachable to a sporting event goal for improving the accuracy and shooting form of a player by providing a visual target to aim at and strike with the sporting event's game piece essentially consisting of:

a clamp having an inner surface which contacts the sporting event's goal and an oppositely facing exterior surface, the clamp configured and adapted to removably attach to the sporting event's goal;

a substantially straight elongated member having first and second ends, the elongated member connected adjacent its first end to the clamp and extending substantially perpendicular from the exterior surface of the clamp such that its second end is located at a point distal from the clamp; and a three-dimensional target member connected adjacent the second end of the elongated member to form a target for the player to aim and attempt to strike with the game piece, wherein the elongated member is configured and adapted such that it (a) deflects when the target member is struck by the game piece so that the target member moves without substantially altering the trajectory of the game piece and (b) returns the target member to its original position after it has been deflected by the game piece.

22. The device of claim 21 wherein the clamp comprises:

upper and lower jaws configured and adapted to cooperate and communicate to grip the basketball hoop;

a set screw wherein the upper and lower jaws are tightened about the basketball rim to removably attach the device to the rim by rotating the set screw.

23. The device of claim 21 wherein the clamp comprises:

a base portion configured and adapted to cooperatively receive and grip a basketball hoop;

a first leg portion configured and adapted to cooperatively receive and grip a basketball hoop and fixedly attached to said base portion;

a second leg portion configured and adapted to cooperatively receive and grip a basketball hoop and to rotatably attach to said base portion having an open position to allow a basketball hoop to pass between the base portion, and first and second leg portions for cooperatively receiving the basketball hoop, and a closed position for gripping of and attachment to the basketball hoop; and a tightening nut configured and adapted to hold and press together the first and second leg portions so that the clamp grips and attaches to the basketball hoop.

* * * * *